US006528544B2

(12) United States Patent
Stern et al.

(10) Patent No.: US 6,528,544 B2
(45) Date of Patent: Mar. 4, 2003

(54) AQUEOUS FOAMING COMPOSITIONS, FOAM COMPOSITIONS, AND PREPARATION OF FOAM COMPOSITIONS

(75) Inventors: Richard M. Stern, Woodbury, MN (US); Pavel L. Blagev, Woodbury, MN (US); Joan E. Manzara, St. Paul, MN (US)

(73) Assignee: 3M Innovative Properties Company, St. Paul, MN (US)

( * ) Notice: Subject to any disclaimer, the term of this patent is extended or adjusted under 35 U.S.C. 154(b) by 0 days.

(21) Appl. No.: 09/858,258

(22) Filed: May 15, 2001

(65) Prior Publication Data

US 2001/0027218 A1 Oct. 4, 2001

Related U.S. Application Data

(62) Division of application No. 09/213,024, filed on Dec. 16, 1998, now Pat. No. 6,262,128.

(51) Int. Cl.[7] ..... B01F 17/00; A62D 1/00; A62C 2/00

(52) U.S. Cl. ..... 516/10; 252/3; 252/8.05; 169/45; 169/46

(58) Field of Search ..... 516/10; 252/3, 252/8.05; 169/45, 46

(56) References Cited

U.S. PATENT DOCUMENTS

| | | | | |
|---|---|---|---|---|
| 3,258,423 A | | 6/1966 | Tuve et al. | |
| 3,562,156 A | | 2/1971 | Francen | |
| 3,772,195 A | | 11/1973 | Francen | |
| 3,957,658 A | | 5/1976 | Chiesa, Jr. et al. | |
| 4,060,489 A | | 11/1977 | Chiesa, Jr. | |
| 4,090,967 A | | 5/1978 | Falk | |
| 4,099,574 A | | 7/1978 | Cooper et al. | |
| 4,149,599 A | | 4/1979 | Chiesa, Jr. | |
| 4,242,516 A | | 12/1980 | Mueller | |
| 4,359,096 A | | 11/1982 | Berger | |
| 4,383,929 A | | 5/1983 | Bertocchio et al. | |
| 4,472,286 A | | 9/1984 | Falk | |
| 4,536,298 A | | 8/1985 | Kamei et al. | |
| 4,594,167 A | | 6/1986 | Kabayashi et al. | |
| 4,795,590 A | | 1/1989 | Kent et al. | |
| 4,795,764 A | | 1/1989 | Alm et al. | |
| 4,822,524 A | | 4/1989 | Strickland | |
| 4,859,349 A | | 8/1989 | Clark et al. | |
| 4,983,769 A | | 1/1991 | Bertocchio et al. | |
| 5,026,735 A | | 6/1991 | Stern | |
| 5,133,991 A | | 7/1992 | Norman et al. | |
| 5,156,765 A | * | 10/1992 | Smrt et al. | 106/31.94 |
| 5,225,095 A | | 7/1993 | DiMaio et al. | |
| 5,296,164 A | | 3/1994 | Thach et al. | |
| 5,849,210 A | | 12/1998 | Pascente et al. | |

FOREIGN PATENT DOCUMENTS

| | | |
|---|---|---|
| WO | WO 98/19743 | 5/1998 |

* cited by examiner

*Primary Examiner*—Jill Warden
*Assistant Examiner*—Monique T. Cole
(74) *Attorney, Agent, or Firm*—Lisa M. Fagan

(57) ABSTRACT

Described are compositions and methods useful for preparing foam compositions. The compositions and method relate to the production of a foam from a composition containing non-hydrated thickener.

8 Claims, 2 Drawing Sheets

AQUEOUS FOAMING COMPOSITIONS, FOAM COMPOSITIONS, AND PREPARATION OF FOAM COMPOSITIONS

This application is a divisional of U.S. application Ser. No. 09/213,024, filed Dec. 16, 1998, which has been allowed, now U.S. Pat. No. 6,262,128, Jul. 17,2001.

FIELD OF THE INVENTION

The invention relates to a process of forming a foam composition, chemical compositions useful to prepare foam compositions, and foam forming compositions.

BACKGROUND

Foam materials are a class of commercially and industrially important chemical-based materials. Foams can be prepared by aerating a foaming composition (i.e., entrapping air in a foaming composition), which can be derived by diluting a concentrated precursor. Many foams require certain physical properties to be appropriately useful in desired applications. Among preferred physical properties for foams is the property of stability, to allow the foam to be in a useful form over an extended period of time and therefore useful where an especially stable foam can be desirable, e.g., fire prevention, fire extinguishment, vapor suppression, freeze protection for crops, etc.

An important class of commercial foams includes aqueous film-forming foams (e.g., AFFFs), aqueous compositions typically containing fluorochemical surfactant, non-fluorinated (e.g., hydrocarbon) surfactant, and aqueous or non-aqueous solvent. These foams can be prepared from concentrates by diluting with water (fresh or sea water) to form a "premix," and then aerating the premix to form a foam. The foam can be dispersed onto a liquid chemical to form a thick foam blanket that knocks down a fire and extinguishes the fire by suffocation. These foams also find utility as vapor suppressing foams that can be applied to non-burning but volatile liquids, e.g., volatile liquid or solid chemicals and chemical spills, to prevent evolution of toxic, noxious, flammable, or otherwise dangerous vapors.

Individual components of a foaming composition contribute toward different physical and chemical properties of the premix and the foam. Fluorinated and non-fluorinated surfactants can exhibit low surface tension, high foamability, and good film-forming properties, i.e., the ability of drainage from the foam to spread out and form a film over the surface of another liquid. Organic solvents can be included to promote solubility of surfactants, to promote shelf life of the concentrate, and to stabilize the aqueous foam. Thickening agents can be used to increase viscosity and stability of the foam.

Especially preferred properties of foams are stability, vapor suppression, and burnback resistance. Stability refers to the ability of a foam to maintain over time its physical state as a useful foam. Some fire-fighting foams, e.g., foams prepared from foaming premix compositions containing surfactant and hydrated thickener, are stable for periods of hours, or less than an hour, and are often regularly reapplied. Longer periods of stability can be achieved by adding ingredients such as reactive prepolymers and crosslinkers, polyvalent ionic complexing agents, proteins, etc.

There exists a continuing need for foaming compositions, foam compositions, and methods of preparing foaming compositions and foams useful for application to a liquid chemical or another substrate which may be volatile, flammable, otherwise hazardous, or not hazardous at all but desirably protected from potential ignition. This includes a particular need for preparing foam compositions that are stable in the form of a useful foam for extended periods of time, e.g., up to or greater than 12, 24, or 36 hours.

SUMMARY OF THE INVENTION

Figure 1:
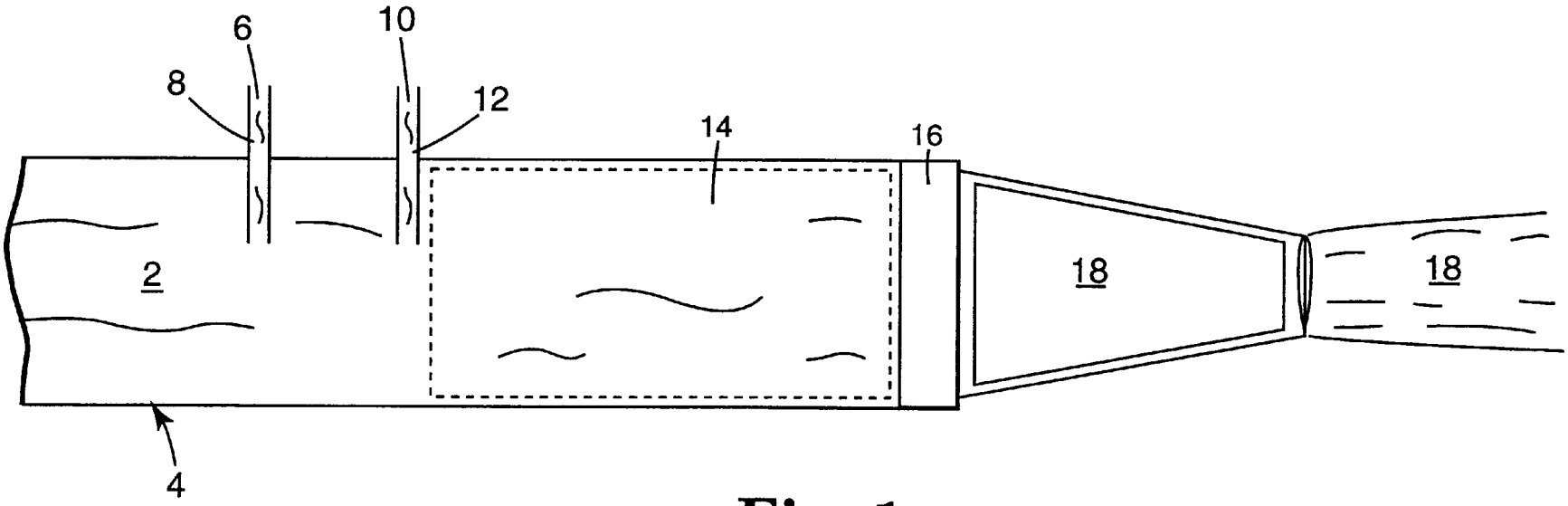
FIGS. 1 and 2 each illustrate embodiments of the inventive method for preparing a foaming composition and a foam composition.

The invention regards chemical compositions that can be aerated to form a foam composition (also referred to as a "foam"). The foam can be used in various applications including any applications understood to be useful in the art of aqueous foam materials. The foam can be useful to contain or suppress volatile, noxious, explosive, flammable, or otherwise dangerous chemical vapors. The vapors may evolve from a chemical such as a chemical storage tank, a liquid or solid chemical, or a chemical spill. The foam can also be used to extinguish a chemical fire or to prevent ignition or re-ignition of a chemical. These applications will be referred to collectively for purposed of the present description as "application to a chemical" or application to a "liquid chemical." The compositions are especially useful for extinguishing and securing extremely flammable (e.g., having low boiling point and high vapor pressure) and difficult-to-secure chemicals, for example transportation fuels such as methyl t-butyl ether (MTBE) and ether/gasoline blends. Additionally, the foam can be applied to other substrates that are not necessarily hazardous, volatile, ignited, or ignitable. As an example, the foam may be applied to land, buildings, or other physical or real property in the potential path of a fire, as a fire break, e.g., to prevent such property from catching fire.

The invention also regards methods of preparing a foam composition. According to the invention, an aqueous foaming composition containing non-hydrated thickener is aerated to a foam. After foam formation, the non-hydrated thickener within the foam hydrates to provide a stable foam. Because the foaming composition includes thickener in a non-hydrated state at aeration, the foaming composition, and therefore the resultant foam composition can contain more thickener that if the thickener were hydrated at aeration. Thus, foaming compositions and foams of the invention can contain relatively more thickener than prior art compositions (containing hydrated thickener), giving foam compositions of the invention increased stability.

In one aspect, the invention relates to a process of forming a foam, the process including the step of aerating an aqueous composition containing non-hydrated thickener, e.g., a foaming composition containing surfactant, water, and non-hydrated thickener.

In another aspect, the invention relates to a process for preparing a foaming composition. The process includes the steps of adding to a flow of water, preferably water flowing through a hose such as a fire-fighting hose, surfactant and non-hydrated thickener. The foaming composition containing non-hydrated thickener can be aerated to a foam.

In yet another aspect, the invention relates to a composition including water, from about 0.05 to about 1 weight percent surfactant, and at least about 0.5 weight percent thickener, based on the weight of the composition. The composition can be in the form of a foaming composition containing non-hydrated thickener and optionally hydrated thickener, or in the form of a foam containing non-hydrated thickener, hydrated thickener, or both.

In yet another aspect, the invention relates to a composition of ingredients including surfactant, non-hydrated thickener, organic solvent, and substantially no water.

In a final aspect the invention relates to a process of improving the stability of a foam. The process includes the step of adding non-hydrated thickener to a foaming composition and aerating the foaming composition containing non-hydrated thickener.

As used herein, the term "foam" is used according to its industry-accepted sense, to mean a foam made by physically mixing a gaseous phase (e.g., air) into an aqueous liquid to form a two phase system of a discontinuous gas phase (e.g., air) and a continuous, aqueous phase.

DETAILED DESCRIPTION

Thickeners, or "thickening agents," useful in aqueous foams are chemical materials that are well known in the art of aqueous foams and aqueous foam production. See generally, e.g., Davidson, *Handbook of Water-Soluble Gums and Resins,* 1980, and Meltzer, *Water-Soluble Polymers Recent Developments*, (1979). Thickeners are specifically known and understood to be useful in fire-fighting foam applications; see, e.g., U.S. Pat. Nos. 4,060,489, 4,149,599, and 5,026,735. Thickeners generally can exist in their substantially pure forms as solids, e.g., in the form of a non-crystalline powder. In this solid form, preferred thickeners can be suspended or dispersed, yet not significantly dissolved, in an organic solvent.

A thickener, upon significant exposure to or contact with water, e.g., in an aqueous composition, will become hydrated by the water, i.e., associate with, dissolve, or become dispersed in the water. Upon hydration the thickener causes a thickening effect or increase in the viscosity of the aqueous composition which is thought to occur through a chemical mechanism involving hydrogen bonding. Thickeners are typically of a relatively high molecular weight, and upon exposure to water do not immediately cause this thickening effect. Instead, a thickener will over a relatively short period of time dissolve or disperse in an aqueous composition to create a solution, a colloidal dispersion, or, if sufficient thickener is present, a gel, of an increased thickness or viscosity.

Complete or full hydration of an amount of thickener in an aqueous composition occurs over an essentially finite period of time referred to herein as a "hydration period. " The length of the hydration period will depend on factors such as the relative amounts of thickener and water in the aqueous composition, temperature and pressure, and, the chemical nature of the thickener. A hydration period can typically be in the range from less than a minute to more than 5 or 10 minutes. In practice, thickener introduced to an aqueous composition (although possibly containing adventitious water) is initially a completely non-hydrated solid. The thickener becomes progressively hydrated during the time the thickener associates with water, at which time some thickener exists in a hydrated state and some exists in a non-hydrated state, and finally, after sufficient time has passed, given a sufficient amount of water, the full amount of thickener will become hydrated to provide a full thickening effect. This state of hydration is referred to as complete, full, or equilibrated hydration.

The term "non-hydrated," or "non-fully thickened" as it relates to a composition containing thickener, is used in the present description to describe an aqueous composition containing thickener, wherein the composition contains some amount of thickener that is not hydrated, e.g., that is not associated with water in the manner described above to cause a thickening effect. The composition is considered to contain "non-hydrated" or "non-fully thickened" thickener even if the composition also contains some or a significant portion of thickener that is hydrated, i.e., associated with water, to thicken the composition. An amount of thickener in a composition is considered to be "substantially non-hydrated" or "partially thickened" if the composition meets any one of the definitions presented infra, or alternatively, if only a minor portion of the total amount of thickener in a composition (e.g., less than about 50 percent by weight) has associated with water to cause a thickening effect.

The state of hydration of thickener in an aqueous composition, e.g., whether an amount of thickener is non-hydrated, substantially non-hydrated, or in a state of equilibrated hydration, can be measured by various analyses. AS examples of methods that may be used to identify the degree of hydration of an amount of thickener, this may be measured by the extent to which the thickener has caused a thickening effect of the aqueous composition, by the amount of time over which the thickener has been exposed to the aqueous composition and the water contained therein, or by the extent to which the thickener has dissolved or remains undissolved within the aqueous composition. Following are specific examples.

The degree of hydration of a thickener in an aqueous composition can be measured by the amount of time the thickener has been contained in an aqueous composition, i.e., in contact with sufficient water to cause hydration. Because equilibrated hydration of an amount of thickener occurs over a hydration period, thickener present in an aqueous composition for a time less than the hydration period will not be fully hydrated, and the composition will contain non-hydrated thickener. A thickener that has been exposed to water for a minor fraction of the hydration period, i.e., less than half of the hydration period, e.g., for a time of 2 minutes, 1 minute, 30 seconds, or 10, 5, or 1 second or less, can be considered to be substantially non-hydrated.

In the alternative, the degree of hydration of an amount of thickener in an aqueous composition can be measured in terms of the degree to which the thickener provides an increase in the thickness or viscosity of the composition. An aqueous composition containing a thickener in a state of full or complete, i.e., equilibrated hydration, will achieve a maximum or equilibrium viscosity. If an aqueous composition that contains thickener has a viscosity that is measurably less than this equilibrium viscosity, the composition is considered to contain non-hydrated thickener. The composition can be considered to contain substantially non-hydrated thickener if the viscosity of the composition is equal to or below a minor fraction of the equilibrium viscosity, for example 50 percent, 25%, or 10 or 5 percent of the equilibrium viscosity.

The degree of a thickening effect can also be measured with respect to the ability of the composition to be aerated to a foam. IN one sense, a foaming composition is useful if it can be formed into a foam. If a foaming composition contains an excessive level of hydrated thickener, the foaming composition may achieve a thickness, i.e., viscosity, that will not allow aeration to a useful foam. A useful foam is one that accomplishes any of the various purposes of such a foam composition, e.g., fire extinguishment or prevention, vapor suppression, etc. A foaming composition can be considered to contain non-hydrated thickener if the foaming composition can be aerated to a useful foam even though the foaming composition contains a sufficient amount of thickener that if the thickener were fully hydrated the foaming composition would not aerate to a useful foam. A foam need not be uniform to be useful, but, for applications such as the use of a foam to extinguish a fire, a foam can preferably exhibit a substantially uniform consistency. A foaming composition can be considered to contain substantially non-hydrated thickener if the foaming composition can be aerated to form a foam of an essentially uniform consistency, even through the foaming composition contains a sufficient amount of thickener that if the thickener were fully hydrated the foaming composition would not aerate to a substantially uniform foam. A foam that is not substantially uniform due to a high level of hydrated thickener at aeration may contain relatively harder or gelled portions caused by an inability of the foaming composition to entrap air by aeration, due to excessive thickness or viscosity of the foaming composition. This effect of course can depend on the aeration equipment that is being used for aeration. It is noted that even though some applications may prefer the production of a substantially uniform foam, a foam that is not substantially uniform may still be useful in these and in other applications, and it is further noted that the production of a foam that may not be substantially uniform is contemplated to be within the scope of the present invention if, as stated supra, the foaming composition contains non-hydrated thickener (in any amount) at aeration.

For thickeners that exist as solids prior to hydration and that dissolve or disperse upon exposure to water and hydration, the degree of hydration of a thickener in a foaming composition can be measured in terms of the degree to which the thickener is dissolved or dispersed in the composition. An aqueous composition can be considered to contain non-hydrated thickener if the composition contains undissolved thickener in any amount. The presence of undissolved thickener may in some cases be identifiable by unaided vision, e.g., by the presence of gelled spheres of non-hydrated thickener in a foam composition. On the other hand, undissolved thickener may not necessarily be detectable by unaided vision.

The above definitions relating to non-hydrated and substantially non-hydrated thickeners are presented as exemplary, alternative, and non-exclusive definitions that may be useful to identify non-hydrated thickener in a foaming or foam composition. If a thickener in a composition fits even one of these definitions, that thickener is considered to be either non-hydrated or substantially non-hydrated; but, just because a thickener does not fall within one or more of the alternate definitions (e.g., if undissolved thickener cannot be detected by unaided vision in a foam), or even if a thickener does not meet any one of these exemplary definitions, this does not mean that the composition does not contain non-hydrated thickener, if non-hydrated thickener can otherwise be shown to be present in the composition.

Thickening agents are well known in the chemical and polymer arts, and include, inter alia, polyacrylamides, cellulosic resins and functionalized cellulosic resins, polyacrylic acids, polyethylene oxides, and the like. One class of thickener that can be preferred for use in the foaming composition and methods of the invention is the class of water-soluble, polyhydroxy polymers, especially polysaccharides. The class of polysaccharides includes a number of water-soluble, organic polymers that can increase the thickness, viscosity, or stability of a foam composition. Preferred polysaccharide thickeners include polysaccharides having at least 100 saccharide units, or a number average molecular weight of at least 18,000. Specific examples of such preferred polysaccharides include xanthan gum, scleroglucan, heteropolysaccharide-7, locust bean gum, partially-hydrolyze starch, guar gum, and derivatives thereof. Examples of useful polysaccharides are described, for example, in U.S. Pat. Nos. 4,060,489 and 4,149,599. These thickening agents generally exist in the form of water-soluble solids, e.g., powders. While they are soluble in water, in their powder form they can and typically do contain a small amount of adventitious or innate water, which is absorbed or otherwise associated with the polysaccharide.

Guar gum is a particularly preferred polysaccharide thickener. The term guar gum, as used herein, refers to materials generally understood as the class of materials known in the chemical art as "guar gum," including water-soluble plant mucilage obtained from *Cyanopsis tetragonoloba*. These materials typically contain galactose and mannose saccharide units in the form of a linear, alternating copolymer (e.g. see p 6-3 and p 6-4 of "Handbook of Water-Soluble Gums and Resins,") having cis 1,2-diol groupings in the saccharide units. The structure can be represented as

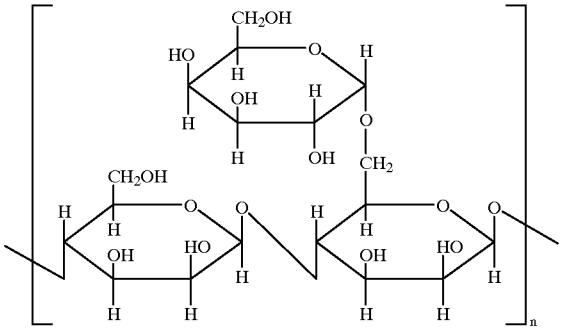

guar gum repeating unit

Also useful as thickeners are derivatives of guar gum such as those formed by etherification and esterification reactions with the hydroxy functionalities. Preferred such derivatives can be those prepared by etherification, e.g. hydroxyethylation with ethylene oxide, hydroxypropylation with propylene oxide, carboxymethylation with monochloroacetic acid, and quaternization with various quaternary amine compounds containing reactive chloro or epoxy sites. In the case of guar gum, each saccharide ring can contain an average of 3 hydroxy-containing substituents. For the guar gum derivatives, molar substitution of hydroxy groups should preferably not exceed an average of one hydroxy group substitution per saccharide ring. A preferred range of molar substitution of hydroxy-containing groups such as hydroxypropyl, can be in the range from about 0.1 to 2 substituents per repeating unit, most preferably from 0.2 to 0.6 substituents per repeating unit.

An especially preferred guar gum derivative is hydroxypropyl guar gum, a commercially available example of which is JAGUAR® HP-11, with an average of 0.35 to 0.45 moles of hydroxypropylation per each anhydrohexose unit. Other useful guar gums include the Jaguar™ series of commercially-available guar gum products, including Jaguar® GCP15, T4072, T4111, T4150, T4315, 6003 (2243), J8801 locust bean gum, and underivatized high molecular weight Jaguar™ 6003 (2243).

Combinations of different thickeners can also be used in a single foaming composition. For example, xanthan gum has been found to be especially useful in combination with other galactomannans; blends of xanthan gum and guar gum, and xanthan gum and locust bean gum have been found to be especially useful.

A foaming composition (also referred to in the fire-fighting art as a "premix") can include ingredients other than thickener and water, for example surfactant. Surfactant can reduce the surface tension of a foaming composition and thereby facilitate the formation of a foam upon aeration. Useful surfactants include non-fluorinated surfactants), and fluorinated surfactants, all of which are generally known in the art of aqueous compositions, including fire-fighting foaming and foam compositions.

Fluorochemical surfactants can provide a foaming composition or foam composition with low surface tension. In fire-fighting applications, a fluorochemical surfactant can reduce the surface tension of a foaming composition to a level below the surface tension of a liquid chemical to which the composition is applied. In this event, drainage from the aqueous phase of the foam composition can readily spread as a vapor-sealing aqueous film over the liquid chemical. Films originating from the drainage of these compositions can have a strong tendency to reform if disturbed or broken, thereby reducing the tendency of the liquid chemical to be ignited or re-ignited.

Preferred fluorochemical surfactants include those known in the art of foam compositions to be useful within aqueous fire-fighting foam compositions. Many varieties of fluorochemical surfactants are well known, and a particular fluorochemical surfactant used in the compositions and methods of the present invention can be any useful surfactant of the various surfactants known in the chemical art. A preferred class of fluorochemical surfactant includes those compounds that contain one or more fluorinated aliphatic radical ($R_f$) and one or more polar solubilizing groups (Z), wherein the radical and solubilizing groups are connected by a suitable linking group (Q), and wherein the surfactant preferably contains at least about 20 percent by weight carbon-bonded fluorine.

The fluorinated aliphatic radical $R_f$ can generally be a fluorinated, saturated, monovalent, non-aromatic radical preferably having at least 3 carbon atoms. The aliphatic chain may be straight, branched, or, if sufficiently large, cyclic, and may include catenary oxygen, trivalent nitrogen, or hexavalent sulfur atoms. A fully fluorinated $R_f$ radical can be preferred, but hydrogen or chlorine may be present as substituents provided that not more than one atom of either is preferably present for every two carbon atoms, and, also preferably, the radical contains at least a terminal perfluoromethyl group. While radicals containing large numbers of carbon atoms will function adequately, compounds containing no more than about 20 carbon atoms are preferred because larger radicals usually represent a less efficient use of fluorine. Fluoroaliphatic radicals containing about 4 to 12 carbon atoms are most preferred.

Polar solubilizing group Z can be an anionic, cationic, nonionic, or amphoteric moiety, or a combination thereof. Typical anionic moieties include carboxylate, sulfonate, sulfate, ether sulfate, or phosphate moieties. Typical cationic moieties include quaternary ammonium, protonated ammonium, sulfonium and phosphonium moieties. Typical nonionic moieties include polyoxyethylene and polyoxypropylene moieties. Typical amphoteric moieties include betaine, suflobetaine, aminocarboxylate, amine oxide moieties, and various combinations of anionic and cationic moieties.

Linking group Q can be a multivalent, generally divalent, linking group such as alkylene, arylene, sulfonamindoalkylene, carbonamidoalkylene, alkylene-sulfonamidoalkylene or alkylenethioalkylene.

A particularly useful class of fluroraliphatic surfactants include those of the formula $(R_f)_n(Q)_m(Z)_p$, wherein $R_f$, Q, and Z are as defined, and n is 1 or 2, m is 0 to 2, and p is 1 or 2. Representative fluorochemical surfactants according to this formula include the following:

$C_8F_{17}SO_3^-\ K^+$
$C_{10}F_{21}SO_3^-\ K^+$
$C_8F_{17}C_2H_4SO_3^-\ K^+$
$C_{12}F_{23}OC_6H_4SO_3^-\ Na^+$
$C_8F_{17}SO_2N(C_2H_5)CH_2COO^-\ K^+$
$C_8F_{17}C_2H_4SC_2H_4N^+\ (CH_3)_2CH_2COO^-$
$C_8F_{17}C_2H_4SC_2H_4Coo^-\ Li^+$
$C_3F_7O(C_3F_5O)_3CF(CF_3)CH_2CH(OH)CH_2N(CH_3)CH_2COO^-\ K+$
$C_8F_{17}SO_2N(C_2H_5)C_2H_4OSO_3^-\ Na^+$
$C_8F_{17}SO_2N(C_2H_5)C_2H_4OP(O)(O^-\ NH_4^+)_2$
$C_4F_9SO_2N(H)C_3H_6N^+(CH_3)_2O^-$
$C_8F_{17}SO_2N(H)C_3H_6N^+(CH^3)_2O^-$
$C_{10}F_{21}SO_2N(H)C_3H_6N^+(CH_3)_2O^-$
$C_7F_{15}CF(CF_3)SO_2N(H)C_3H_6N^+(CH_3)_2O^-$
$C_7F_{15}CON(H)C_3H_6N^+(CH_3)_2O^-$

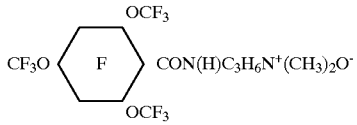

$C_6F_{13}C_2H_4SO_2N(II)C_3H_6N^+\ (CH_3)_2O^-$
$C_5F_{13}SO_2N(C_2H_4COO^-)\ C_3H_6N^+(CH_3)_2H$
$C_8F_{17}C_2H_4CONHC_3H_6H^+(CH_3)_2C_2H_4COO^-$
$C_6F_{13}SO_2N(C_3H_6SO_3^-)C_3H_6N^+(CH_3)_2H_4OH$
$C_6F_{13}SO_2N(CH_2CHOHCH_2SO_3^-)C_3H_6N^+(CH_3)_2C_2H_4OH$
$C_7F_{15}CF{=}CHCH_2N(CH_3)CH_2CH_2OSO_3^-\ Na^+$
$C_8F_{17}SO_2N(H)C_3H_6N^+(CH_3)_3Cl^-$
$C_6F_{13}SO_2N(H)C_3H_6N^+\ (CH_3)_3CH_3CH_3OSO_3^-$
$C_6F_{13}SO_2N(C_2H_5)C_3H_6N(H)CH_2CH(OH)CH_2SO_3^-Na^+$
$C_6F_{13}C_2H_4SO_2N(CH_3)C_2H_4N^+\ (CH_3)_2C_2H_4COO^-$
$C_6F_{13}C_2H_4SO_2N(H)C_3H_6N^+\ (CH_3)_2C_2H_4COO^-$
$C_6F_{13}CH_2CH(OCOCH_3)CH_2N^+\ (CH_3)_2CH_2COO^-$
$C_8F_{17}SO_2N(C_2H_5)(C_2H_4O)_7CH_3$
$C_8F_{17}(C_2H_4O)_{10}OH$

Examples of these and other flurorchemcial surfactants are described, for example, in U.S. Pat. Nos. 3,772,195 (Francen), 4,090,967 (Falk), 4,099,574 (Cooper et al.), 4,242,516 (Mueller), 4,359,096 (Berger), 4,383,929 (Bertocchio et al.), 4,472,286 (Falk), 4,536,298 (Kamei et al.), 4,795,764 (Alm et al.), 4,983,769 (Bertocchio et al.) and 5,085,786 (Alm et al.).

Non-fluorinated surfactants can be included in the foaming composition to facilitate foam formation upon aeration, to promote spreading of drainage from the foam composition as a vapor sealing aqueous film over a liquid chemical, and, where desired, to provide compatibility of a fluorochemical surfactant with sea water. Useful non-fluorinated surfactants include water-soluble hydrocarbon surfactants and silicone surfactants, and may be non-ionic, anionic, cationic, or amphoteric. Particularly useful non-fluorinated surfactants include hydrocarbon surfactants which are anionic, amphoteric, or cationic, e.g., anionic surfactants preferably having a carbon chain length containing from about 6 to about 12 or 20 carbon atoms.

Examples of nonionic non-fluorinated surfactants include ethylene oxide-based surfactants such as $C_nH_{2n+1}O(C_2H_4O)_mH$ where n is an integer between about 8 and 18 and m is greater than or equal to about 10; ethoxylated alkylphenols such as

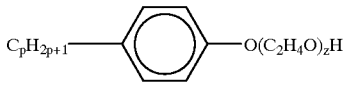

where p is an integer between about 4 and about 12 and z is greater than or equal to about 10, and block copolymers of ethylene oxide and propylene oxide such as Pluronic™ F-77 surfactant (containing at least about 30 weight % ethylene oxide) available from BASF Corp., Wyandotte, Mich.

Examples of useful anionic fluorine-free surfactants include alkyl sulfates, such as sodium octyl sulfate (e.g., Sipex™ OLS, commercially available from Rhone-Poulenc Corp., Cranberry, N.J.) and sodium decyl sulfate (e.g., Polystep™ B-25, commercially available from Stepan Co., Northfield, Ill.); alkyl ether sulfates such as $C_nH_{2n+1}(OC_2H_4)_2OSO_3Na$, where $6 \leq n \leq 12$(e.g., Witcolate™ 7093, commercially available from Witco Corp., Chicago, Ill.); and alkyl sulfonates such as $C_nH_{2n+1}SO_3Na$, where $6 \leq n \leq 12$.

Examples of useful amphoteric non-fluorinated surfactants include amine oxides, aminopropionates, sultaines, alkyl betaines, alkylamindobetaines, dihydroxyethyl glycinates, imadazoline acetates, imidazoline propionates, and imidazoline sulfonates. Preferred non-fluorinated amphoteric surfactants include: salts of n-octyl amine di-propionic acid, e.g., $C_8H_{17}N(CH_2CH_2COOM)_2$ where M is sodium or potassium; Mirataine™ H2C-HA (sodium laurimino dipropiionate), Miranol™ C2M-SF Conc. (sodium cocoampho propionate), Mirataine™ CB (cocanndopropyl betaine), Mirataine™ CBS (cocamidopropyl hydroxysultaine), and Miranol™ JS Conc. (sodium caprylampho hydroxypropyl sultaine), all commercially available from Rhone-Poulene Corp.; and those imidazole-based surfactants described in U.S. Pat. No. 3,957,657 (Chiesa, Jr.), the description of which is hereby incorporated by reference.

Organic solvent can be included in a foaming composition to promote solubility of a surfactant, to improve shelf life of a concentrated adaptation of the foaming composition, to stabilize the foam, and in some cases to provide freeze protection. Organic solvents useful in the foaming composition include but are not limited to diethylene glycol n-butyl ether, dipropylene glucol n-propyl ether, hexylene glycol, ethylene glycol, dipropylene glycol monobutyl ether, dipropylene glycol monomethyl ether, dipropylene glycol monopropyl ether, propylene glycol, glycerol, polyethylene glycol (PEG), and sorbitol.

Other optional ingredients may be included in a foaming composition, as needed and in amounts that will be readily understood by those skilled in the art of aqueous foam compositions. Such optional ingredients can include corrosion inhibitors, buffers, antimicrobial agents, divalent ion salts, and humectants (e.g., sucrose, corn syrup, etc.).

Also known in the art of foam compositions is the employment of additional agents to further stabilize a foam over time. These include, e.g., polyvalent ionic complexing agents which stabilize through hydrogen bonding crosslinking, protein hydrolysates, and prepolymers (e.g., polyisocyanates) and crosslinking agents that react upon foam formation to form a stabilizing polymer through covalent crosslinking. See, e.g., U.S. Pat. No. 5,026,735, the disclosure of which is incorporated herein by reference; See also U.S. Pat. Nos. 5,225,095, 4,795,764, and 4,795,590. Specific examples of complexing agents include alkali metal borates, alkali metal pyroantimonates, titanates, chromates, vandanates, etc. While such stabilizing additives, polyvalent ionic complexing agents, protein hydrolysates, and reactive polymers and crosslinkers may be used to further stabilize the foam compositions of the present invention, they are not required, and in many or most applications, compositions of the present invention and compositions for use in the processes of the present invention can preferably and advantageously exclude such complexing agents.

Thickener can be included in a foaming or foam composition in any amount that if hydrated can stabilize a foam. While a foaming composition of the invention contains non=hydrated thickener at aeration, a foaming composition may also include some amounts of hydrated thickener. This may be because the residence time of the thickener in the foaming composition prior to aeration is sufficiently long to allow hydration of some amount of the thickener, because hydrated thickener has been added as part of a surfactant-containing concentrate, or for any other reason. Hydrated thickener will increase the thickness and viscosity of the foaming composition, and at some threshold concentration of hydrated thickener, the viscosity of the foaming composition becomes too high to allow efficient, practical aeration of the foaming composition to form a foam. Thus, a foaming composition may contain hydrated thickener, but preferably contains a minimum amount of hydrated thickener, or an amount not large enough to prevent aeration of the foaming composition to a useful foam.

The foaming composition contains non-hydrated thickener that does not prevent the composition from being aerated to a useful foam, and which will hydrate after formation of the foam and further stabilize the foam composition. An advantage of the method of the invention is that because the foaming composition contains non-hydrated thickener, i.e., because the foaming composition is aerated while the thickener in the composition is completely, substantially, or even partially non-hydrated, the foaming composition, and the resultant foam, can contain thickener in greater amounts than if the thickener were fully hydrated at aeration. The relative amount of non-hydrated thcikener versus hydrated thcikener in a foaming composition can be maximized by aerating the foaming composition (aeration is detailed infra) soon or immediately after introduction of the non-hydrated thickener to the foaming composition.

Preferred foaming compositions contain a sufficient amount of thickener to provide a highly stable foam. This can mean, for instance, that a foam composition containing e.g., water, surfactant, and thickener, and preferably no polyvalent ionic complexing agent, no protein hydrolysate, and no reactive polymers or crosslinking agents, can remain in the form of a useful foam for up to 24 hours, or even up to 48 hours or more. As measured by the National Fire Protection Association (NFPA) standard number 412, a preferred foam composition can contain sufficient thickener, in the absence of crosslinker, polyvalent ionic complexing agent, or protein hydrolysate, etc., to exhibit a 75% drain time of at least ninety minutes, more preferably 3 hours, 8 hours, 12 hours, 24 hours, or more.

Examples of specific amounts of thickener in a foaming or foam composition can be in the range from about 0.001 to 10 weight percent thickener (meaning the total amount of hydrated and non-hydrated thickener) based on the total weight of the composition, with the ranges from about 0.01 to about 5, and from about 0.05 to about 1.5, 2, or 3 weight percent being preferred, and with the range from about 0.1 to about 1.0, e.g., about 0.5 weight percent thickener being particularly preferred.

The amounts of other ingredients in a foaming composition can vary significantly, and those skilled in the art of aqueous foams will understand useful ranges. The major portion of the foaming composition can be water, which can be either salt water (e.g., sea water) or fresh water. The amount of water can be an amount that provides sufficiently low viscosity of the foaming composition to allow efficient handling and aeration to a foam. Generally, water will comprise at least 50 weight percent of the foaming composition, e.g., from about 55 to 99.5 weight percent of the foaming composition.

Amounts of surfactant generally, and of fluorochemical surfactant and non-fluorinated surfactant specially, and amounts of optional organic solvent, to be used in a foaming composition, are known and understood in the art of aqueous foam compositions. As examples of useful ranges, foaming and foam compositions can preferably contain from about 0.05 to 1 weight percent surfactant based on the total weight of the composition; e.g., from about 0.05 to 0.3 weight percent fluorochemical surfactant, from zero to about 0.95 weight percent fluorine-free surfactant; and from about 0.05 and 5.0 weight percent organic solvent, based on the total weight of the composition.

A foaming composition can be prepared by mixing or combining together its ingredients, e.g., water, thickener, and surfactant, plus any additionally desired ingredients. For example, a foaming composition can be prepared by providing water, e.g., a fixed amount within a reaction vessel or other container, or preferably a flow of water traveling through a hose or pipe, most preferably a hose, and then adding non-water ingredients (e.g., surfactant, thickener, etc.) to the water. The non-water ingredients can be added to the water individually or as one or more mixtures, and in any desired order. While both surfactant and thickener can be added to a flow of water at any convenient point of the flow, non-hydrated thickener can preferably be added to a flow of water at a position near the point of aeration, so that at aeration, as much thickener as possible remains in a non-hydrated state. The residence time of non-hydrated thickener in a foaming composition flowing through a hose, prior to aeration, should be brief enough that the thickener does not become fully hydrated before aeration. Preferred residence times of the thickener in the foaming composition, prior to aeration, are sufficiently brief to provide a thickener that is substantially non-hydrated at aeration; examples of particular preferred residence times can be below about one minute, e.g., 30 seconds, and can most preferably be less than 10 seconds, e.g., 5 seconds, 1 second, or less.

A foaming composition can be prepared using foam production equipment known in the fire-fighting art. Such equipment can include a conventional hose to carry a flow of water, plus appurtenant equipment useful to inject, educt, or otherwise add non-water ingredients to the flow of water. Water can flow under pressure through a fire hose, and surfactant, thickener, and other non-water ingredients can be injected or drawn (e.g., educted by venturi effect) into the flow of water.

In one embodiment of the method, a foaming composition can be prepared by educting thickener and surfactant into water flowing through a hose, wherein the thickener and surfactant are educted as two separate flows of ingredients, a concentrate comprising a concentrated surfactant solution, and a thickener suspension comprising thickener and non-aqueous solvent. This method is illustrated in FIG. 1.

FIG. 1 illustrates a flow of water 2 through hose 4. Thickener suspension 6 is educted into water 2 at eductor 8. Surfactant 10, optionally and preferably a concentrate in solution or admixture with other desired ingredients, is educted into water 2 at eductor 12. (While FIG. 1 shows eduction of thickener suspension 6 upstream from concentrate 10, the surfactant and thickener may be added in any order.) Addition of thickener suspension 6 and concentrate 10 to water 2 provides a foaming composition 14, containing non-hydrated thickener. Foaming composition 14 flows to and through aerator 16, where it is aerated to form foam 18. The non-hydrated thickener may or may not be uniformly dispersed in foaming composition 14, but aeration of the foaming composition will substantially uniformly dispersed the thcikener into the resulting foam. Foam 18 initially contains non-hydrated thickener which becomes hydrated over time to stabilize the foam.

In one embodiment, a concentrate, e.g., containing surfactant 10 of FIG. 1, can include the surfactant (e.g., fluorinated surfactant, non-fluorinated surfactant, or both), organic solvent, water, and optionally thickener. If thickener and water are both present in the concentrate, the thickener will likely be hydrated (if present for sufficient amount of time, equal to or greater than the hydration period), and, as stated supra, the amount of hydrated thickener in the foaming composition at aeration should preferably be sufficiently low to allow effective foam formation. Although the composition of a concentrate may vary, and amounts outside of the following ranges can also be useful, many useful and commercially available concentrates contain from about 1 to 10 parts by weight flurorchemcial surfactant, from about 1 to 30 parts by weight fluorine-free surfactant, and from about 0.7 to 1.5 parts by weight thickener, based on 100 parts concentrate, with the balance being water. Many commercially available concentrates can contain amounts of solids as identified above, from about 5 to 50 parts by weight organic solvent, and the balance water or organic solvent (based on 100 parts by weight of the concentrate). Such commercially available concentrates are known in the fire-fighting art as AFFF (Aqueous Film-Forming Foam) concentrates, and are available, for example, from 3M Company of St. Paul Minn., and from National Foam, Inc., of Lionville Pa.

The relative amounts of ingredients including in a concentrate can depend upon whether the concentrate is designated a 1%, 3%, or 6% concentrate. These designations are understood in the fire-fighting art; i.e., concentrates can generally be referred to as "6%", "3%," or "1%" concentrates, meaning that the concentrate can be diluted 15.7, 32.3, or 99 fold, by volume, respectively, with fresh or sea water, to form a foaming composition.

A thickener suspension such as thickener suspension 6 of FIG. 1 can contain non-hydrated thickener, preferably in the form of a solid (e.g., powder), dispersed or suspended in a non-aqueous solvent, and preferably contains substantially no water. Thickener suspensions can preferably contain from about 1 to 66 percent by weight thickener, e.g., about from about 1 to 33 wt. % thickener, in a non-aqueous solvent.

Suitable non-aqueous solvents for the thickener suspension include glycol ethers such as dipropylene glycol methyl ether, dipropylene glycol n-propyl ether, dipropylene glycol n-butyl either, tripropylene glycol methyl ether and diethylene glycol n-butyl ether; and polyethylene glycols having molecular weights ranging from 200 to 600. The glycol ethers typically provide suspensions having lower viscosities (e.g., from 100 to 300 centipoise) but are not stable, while the polyethylene glycols can provide suspensions that are more stable but have higher viscosities (e.g., from 1000 to 3000 centipoise). The non-aqueous solvent can be present in the suspension at about 50 to 80% by weight. Preferably, a blend of glycol ether and polyethylene glycol can be used as the non-aqueous solvent, with the glycol ether present at about 5 to 50 percent by weight, preferably at about 10% by weight of the solvent blend.

The thickener suspension can optionally contain an anti-settling agent such as MPA-1075, Rheolate™ 225, kaolin and bentonite, used at concentrations in the non-aqueous suspension of about 0.1 to 1.5% by weight.

Figure 2:
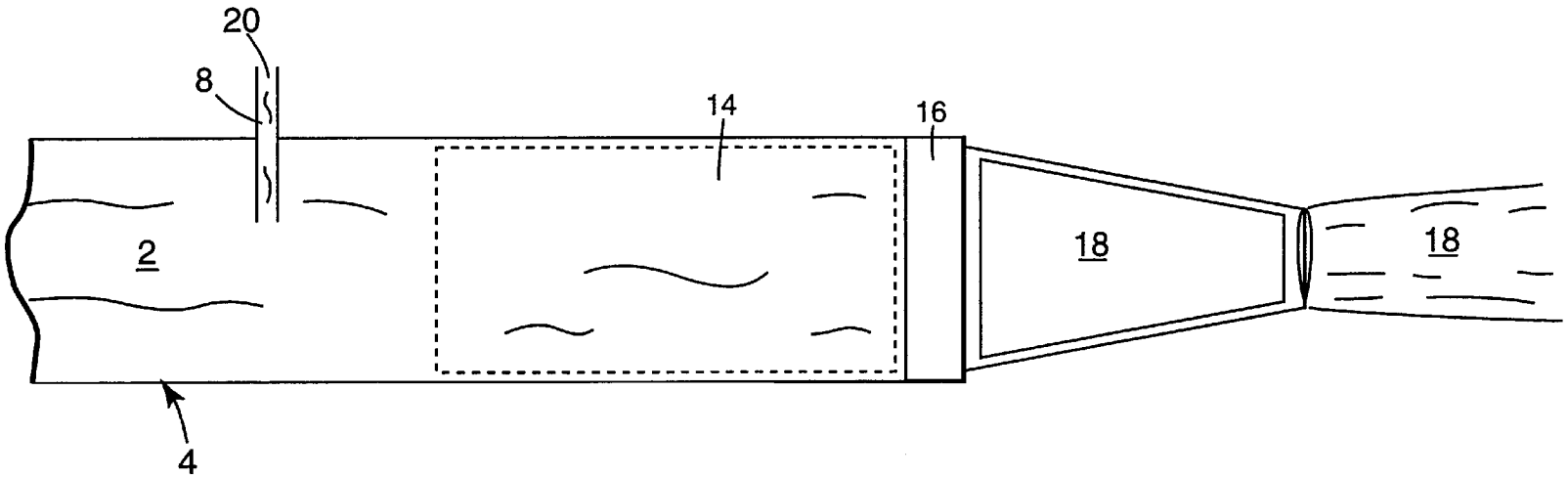

In another embodiment, all of the non-water ingredients of the foaming composition can be added to the water as a single concentrate. This can be in the form of a preferred concentrate containing surfactant, non-hydrated thickener, organic solvent, and substantially no water, e.g., less than 10%, preferably less than about 5 wt. %, 1 wt. %, 0.5, or 0.1 wt. % water, and most preferably no water. The amounts of ingredients in such a concentrate can vary, and can be any amounts that will allow the preparation of a useful foam composition from the concentrate, e.g., having amounts of ingredients as specified supra. Particularly, the amounts of ingredients in a concentrate can depend on the amount of the water expected to be combined with the concentrate to prepare a foaming composition, e.g., if the concentrate needs to be diluted approximately 16, 33, or 99 fold, or some other multiple, with water. Exemplary ranges of organic solvent, thickener, and surfactant in this type of concentrate can be, e.g., in the range from about 1 to about 66 weight percent thickener and from about 1 to about 25 weight percent surfactant, with the balance being organic solvent. Preferred amounts can be in the ranges from about 5 to 50 weight percent thickener, 1 to 10 weight percent fluorinated surfactant, 1 to 10 weight percent non-fluorinated surfactant, and 30 to 95 weight percent organic solvent, based on the total amount of concentrate. A concentrate containing both thickener (preferably non-hydrated) and surfactant can be added to a flow of water as a single input stream, as shown in FIG. 2, wherein concentrate 20 containing non-hydrated thickener, surfactant, and organic solvent, is educted into water 2 flowing through hose 4 at eductor 8. Addition of concentrate 20 to water 2 provides a foaming composition 14, containing non-hydrated thickener and surfactant. Foaming composition 14 flows to and through aerator 16, where it is aerated to form foam 18.

The foaming composition, containing ingredients as described above, preferably exists as a transitory composition as a flow of water within a fire-fighting hose most preferably at a position in the hose immediately preceding aerating equipment. After formation of the foaming composition, and before full hydration of the thickener, the foaming composition can be aerated by methods that are well understood in the art of foam compositions, e.g., using an air-aspirating nozzle, to form a foam composition comprising a vapor phase (e.g., air) entrained in a liquid phase (e.g., aqueous). The amount of air generally included in the foam can be such that the air will be the major component of the foam by volume, e.g., greater than about 50 percent by volume, preferably in the range from about 75 to 98 percent by volume air. The foam for most applications will preferably have an density of less than 1 gram per cubic centimeter, and preferably an expansion value (volume of foam in ml per weight of foam in grams) generally greater than 1.5, preferably from about 2 to 20, optionally as high as 200 or even 1000. The liquid phase has the same chemical composition as the chemical composition of the foaming composition, and includes a major amount of water, plus non-water ingredients including surfactant and thickener, with some of the thickener, preferably a substantial amount of the thickener, being initially non-hydrated and remaining substantially non-hydrated until aeration to a foam. Over a relatively short period of time, e.g., a matter of minutes or less, the thickener in the aqueous phase of the foam will hydrate to stabilize the foam.

While not wishing to be held to any particular theory, it is believed that in order to produce a foam with long drain time, the viscosity of the foaming composition can preferably be as low as possible prior to foam generation, and the viscosity of the aqueous phase of the foam should build as quickly as possible subsequent to foam generation. To accomplish this, the thickener can be incorporated into the foaming composition solution just prior to aeration by the fire-fighting air-aspirating nozzle (aerator).

The foam composition can be applied to a variety of substrates, as already stated, including liquid chemicals. The foam can spread quickly as a thick yet mobile blanket over a surface of a liquid chemical, for rapid coverage and/or extinguishment of a fire. In the case of a burning liquid chemical, drainage from the foam composition (i.e., the aqueous phase) can drain and spread as a film over the surface of the liquid chemical which, if the film becomes disturbed or broken, tends to reform to seal vapors (sometimes existing at elevated temperatures) and prevent ignition or re-ignition of the liquid chemical. The foam composition can preferably remain in the form of a foam blanket over the liquid chemical to provide continued vapor suppression and resistance to ignition or re-ignition (i.e., burnback resistance) of the liquid chemical for a significant time after extinguishment. Preferably the foam can remain in a stable, useful foam state for a period of up to and exceeding 24 or even 48 hours after formation, can preferably provide vapor suppression for greater than 6 hours, and can preferably provide resistance to burnback of a chemical fire for over 30 minutes.

TEST METHODS

Foam Generation Procedure 100 g (100 mL) of the desired premix was placed in a Waring laboratory blender (model 31BL91 7010), followed by 3 mL of a desired non-aqueous thickener suspension containing non-hydrated thickener. The resulting mixture was immediately aerated by blending at high speed for 10 seconds to produce a stabilized foam.

Foam Expansion

In running the Foam Generation Procedure, the foam expansion is calculated as the volume in milliliters, measured by graduations on the blender, of foam generated divided by the initial premix volume (typically 100 mL).

Foam Stability Tests

Stability of a foam was measured by determining 25% Drain Time, 75% Drain Time, Foam Persistence, and/or Foam Height over time.

25% Drain Time

The 25% Drain Time of a foam was determined by measuring the amount of time required for 25 mL of the 100 mL of liquid in the foam, generated using the Foam Generation Procedure, to drain out of the foam. This was done by transferring the generated foam from the blender to a graduated cylinder and noting the time when 25 mL of liquid accumulated in the bottom of the graduated cylinder.

75% Drain Time

The 75% Drain Time of a foam was determined by measuring the amount of time required for 75 percent of the liquid (typically about 100 mL) in the foam to drain out. The foam was generated by placing 97 g of the desired premix and 3 ml of thickener suspension in a Hobart (model N-50) mixer, and immediately mixing at the high speed setting for 15 seconds. All of the foam was then quickly transferred from the Hobart mixer to a graduated 2000 mL beaker, and the time noted when 75 mL of liquid accumulated in the bottom of the beaker.

Foam Persistence

The foam persistence was measured by transferring the foam generated using the Foam Generation Procedure to an aluminum pan (12.7 cm×10.2 cm×7.6 cm deep) and observing the foam behavior. The Foam Persistence was determined as the time required for the foam to collapse completely.

Foam Height

The foam height was measured by transferring the foam generated using the Foam Generation Procedure to an aluminum pan (12.7 cm×10.2 cm×7.6 cm deep) and measuring the depth of the foam with a small ruler at various times.

Vapor Suppression Test

A round metal pan, 16.5 cm in diameter and 7.5 cm in height, was filled with 250 g a flammable liquid fuel as indicated in the data tables. 100 g of foam generated using the Foam Generation Procedure was poured on top of the fuel surface. After every 1 minute interval, a 10 second attempt was made to ignite the fuel vapors by passing a match within 2 cm of the pan perimeter. The endpoint of the test was defined as the time, in minutes elapsed, when the foam was no longer able to suppress the fuel vapors and ignition resulted.

50% Burnback Resistance Test

A round metal pan, 16.5 cm in diameter by 7.5 cm in height, was filled with 250 g of the flammable liquid fuel. A small copper pipe, 3.5 cm in diameter and 4.7 cm in height, was placed in the center of the fuel-containing pan. 100 g of foam generated using the Foam Generation Procedure was poured on top of the fuel surface in the annular space between the pipe and pan, leaving open the central area inside the pipe. After 15 minutes, the fuel inside the copper pipe was ignited and was allowed to burn for 3 minutes. Then the copper pipe was gently removed from the pan, allowing the flames to become in direct contact with the foam blanket, and a timer was started. The fire was allowed to spread until 50% of the foam blanket had been destroyed by the heat of the burning fuel, and the time of this event was recorded as the 50% burnback time.

Fire Extinguishing Test

A round metal pan, 16.5 cm in diameter and 7.5 cm in height, was filled with 250 g of flammable liquid fuel. The fuel was ignited and allowed to burn for 60 seconds. The foam to be tested was poured on the burning fuel at a slow, steady rate, until the fire was extinguished. The length of time (sec) required for the fire to be extinguished, and the amount (grams) of foam used to extinguish the fire were recorded. The application rate was calculated from these values.

GLOSSARY OF MATERIALS

Jaguar™ 2243—a guar gum available from Rhone Poulanc

MPA-1075—an anti-settling agent available from Rheox, Inc.

PEG 300—poly(ethylene glycol) having a number average molecular weight (Mn) of approximately 300, available from Union Carbide Corp., Danbury, Conn. as Carbowax™ 300 glycol.

ATC-603—a 3M™ Light Water™ AR-AFFF form concentrate designed for extinguishing both polar and non-polar flammable organic liquids, available from 3M Company, St. Paul, Minn.

Xanthan gum—a polysaccharide containing mannose, glucose, and salts of glucuronic acid, available from Kelco as Kelzan™.

Locust Bean gum—a polysaccharide containing galactose and mannose, available from Gumix International.

IPA—isopropyl alcohol

MTBE—methyl t-butyl ether

Actigum CX9YLIM—a xanthan gum, available from Sanofi Bio Industries.

Kaolin—a clay of very fine particle size, available from Engelhard Corp.

FC-203CF—a 3M™ Light Water™ AFFF foam concentrate, available from 3M Company, St. Paul, Minn.

Pusher 500—a polyacrylamide, available from Dow Chemical Company.

Elvanol 72-60—a polyvinyl alcohol, available from DuPont.

Soluble Starch—suitable for iodometry, available from Merck.

Gelatin GX45 L404—available from Matheson Coleman & Bell Mfg. Chemists, Norwood, Ohio Cyanamer A-370—a polyacrylonitrile that has undergone 70% hydrolysis with potassium hydroxide to polyacrylate/acrylonitrile, available from Cytec Ind.

Klucel type J—hydroxypropylcellulose, available from Hercules Corp.

Sodium Carboxymethylcellulose (DH)—available from Penn Carbose, Inc.

Jaguar Plus—a high molecular weight cationic guar derivative, available from Stein Hall.

Amine Oxide Foamer A—a fluorinated amine oxide surfactant (86% in water) made as described in WO 9746283.

Amine Oxide Foamer B—a fluorinated amine oxide surfactant (60% in water) made as described in WO 9746283.

Miranol C2M-SF A—an amphoteric, hydrocarbon surfactant (70% in water), available from Rhone Poulanc.

Miranol C2M-SF B—an amphoteric, hydrocarbon surfactant (39% in water), available from Rhone Poulanc.

Miratine CBS—an amphoteric, hydrocarbon surfactant, available from Rhone Poulanc.

SOS—sodium octyl sulfate

SLS—sodium lauryl sulfate

Witcolate 7093—a sodium $C_6$—$C_{10}$ alkyl ether sulfate surfactant, available from Witco, Greenwich Conn.

SDS—sodium decyl sulfate

Tolytriazole—a corrosion inhibitor, available from PMC Specialties.

DPnP—di(propylene glycol) n-propyl ether

DPM—di(propylene glycol) methyl ether

KelzanTM—xanthan gum, available from Kelco Company.

Starch H277—a modified corn starch, available from Staley Mfg. Co.

Rheolate 2001-an anti-settling/stabilizer agent, available from Rheox, Inc.

Bentone SD2—an anti-settling agent, available from Rheox, Inc.

Stanpol 530-hydroxy propylated corn starch from A. E. Staley Mfg. Co., Decatur Ill.

Dupanol ME—now Supralate ME Dry, available from Witco.

EXAMPLE 1

A non-hydrated thickener suspension was prepared by combining and mixing the following components thoroughly until a smooth, homogeneous consistency was reached.

| Component | Parts by weight |
|---|---|
| Jaguar ™ 2243 (thickener) | 33 |
| MPA-1075 (anti-settling agent) | 0.7 (solids) |
| Di(propylene glycol) methyl ether (organic solvent) | 4 |
| PEG300 (organic solvent) | 62.3 |

Using the Foam Generation Procedure, a stabilized air foam was made with a blend of a 3% tap water solution of ATC-603 and the above thickener suspension. Foam Expansion and Foam Persistence tests were run on the stabilized foam, and results are shown in Table 1.

The above procedure was repeated except that the stabilized foam was immediately transferred to a clear graduated cylinder for observation of 25% Drain Time. Results are shown in Table 1.

EXAMPLE 2

A thickener suspension was prepared as in Example 1 with the following components:

| Component | Parts by weight |
|---|---|
| Xanthan gum/locust bean gum (1:1)(thickener) | 4.1 |
| MPA-1075 (anti-settling agent) | 0.7(solids) |
| Di(propylene glycol) methyl ether (organic solvent) | 4 |
| PEG300 (organic solvent) | 91.2 |

The thickener suspension was mixed and aerated with ATC-603, using the Foam Generation procedure. Foam Expansion, Foam Persistence, and 25% Drain Time were determined as in Example 1. Results are shown in Table 1.

COMPARATIVE EXAMPLE C1

A foam was prepared from a 3% tap water solution of ATC-603 alone, using the Foam Generation procedure. Foam Expansion, Foam Persistence, and 25% Drain Time test results, determined as in Example 1, are shown in Table 1.

TABLE 1

| Example | Formulation Description | Foam Expansion | 25% Drain Time | Foam Persistence |
|---|---|---|---|---|
| C1 | 3% ATC-603 | 6.0 | 8 min. | <4 hours |
| 1 | 3% ATC-603, 1% Jaguar ™ 2243 | 4.5 | >>48 hours | >>48 hours |
| 2 | 3% ATC-603, 0.12% X/L | 4.5 | 20 hours | >48 hours |

X/L = xanthan gum/locust bean gum (1:1)

The 25% Drain Time and Foam Persistence data in Table 1 demonstrate an extremely large increase in foam stability, while maintaining good Foam Expansion, as a result of adding the thickener suspensions.

EXAMPLE 3

Preparation of the foam of Example 1 was repeated, and the foam was tested on various flammable liquids for vapor suppression. Results are shown in Table 2.

EXAMPLE 4

Preparation of the foam of Example 2 was repeated, and the foam was tested on various flammable liquids for vapor suppression. Results are shown in Table 2.

COMPARATIVE EXAMPLE C2

Preparation of the foam of Comparative Example 1 was repeated, and the foam was tested on various flammable liquids for vapor suppression. Results are shown in Table 2.

TABLE 2

| | Formulation | Vapor Suppression Time (min.) | | | | |
|---|---|---|---|---|---|---|
| Example | Description | IPA | Acetone | Gasoline | MTBE | n-Heptane |
| C2 | 3% ATC-603 | 24 | 14 | 28 | 18 | 125 |
| 3 | 3% ATC-603 w 1% Jaguar ™ 2243 | 95 | 30 | >360 | >360 | >1080 |
| 4 | 3% ATC-603 w 0.12% X/L | Not measured | >90 | Not measured | >360 | >1440 |

The data in Table 2 show that the addition of the thickener suspensions of the present invention greatly increase the length of time that vapor arising from a wide range of flammable liquids is suppressed.

EXAMPLE 5

Preparation of the foam of Example 1 was repeated, and the foam was tested on various flammable liquids for 50% burnback resistance. Results are shown in Table 3.

COMPARATIVE EXAMPLE C3

Preparation of the foam of Comparative Example C1 was repeated, and the foam was tested on various flammable liquids for 50% burnback resistance. Results are shown in Table 3.

TABLE 3

| Example | Formulation Description | 50% Burnback Resistance (seconds) IPA | Acetone | Gasoline | MTBE |
|---|---|---|---|---|---|
| C3 | 3% ATC-603 | 22 | −78[1] | −20[1] | −132[1] |
| 5 | 3% ATC-603 w 1% Jaguar ™ 2243 | >960 | >960 | >>350[3] | >>350[3] |
| | | 27.5%[2] | 32.5%[2] | | |

[1]The minus sign indicates that the 50% Burnback occurred this many seconds before the usual 3 minute mark (time = 0 for Burnback Resistance) for removal of the copper pipe, resulting in a failure to achieve burnback resistance.
[2]Because of high burnback resistance, the percent burnback at 960 seconds was only 27.5% for IPA and 32.5% for acetone, significantly less than the full 50% normally used as the endpoint.
[3]Because this continued to self extinguish, the result of the Burnback Resistance test would be considerably greater than 350 seconds.

EXAMPLE 6

Preparation of the foam of Example 1 was repeated, the Foam Expansion was measured, and the foam stability was tested by measuring Foam Height initially, at 24 hours, and at 48 hours, or by observing the presence of foam at these times. Results are shown in Table 4.

EXAMPLE 7

A thickener suspension was prepared as in Example 1 with the following components:

| Component | Parts by weight |
|---|---|
| Actigum CX9YL1M (thickener) | 33 |
| Di(propylene glycol) methyl ether (organic solvent) | 67 |

A 3% aqueous solution of ATC-603 (100 ml) was placed in a blender with 3 ml of the thickener suspension. The mixture was immediately aerated by blending for 10 seconds on high speed, and the Foam Expansion was noted. The foam was transferred to a small aluminum tray, and the Foam Height was measured initially, at 24 hours, and at 48 hours. The results are shown in Table 4.

EXAMPLE 8

A thickener suspension was prepared and tested as in Example 7, using Jaguar™ 2243 in place of Actigum. The results are shown in Table 4.

EXAMPLE 9

A thickener suspension prepared as in example 1, using Kaolin (in equal amount) in place of MPA-1075, was tested as in Example 7. The results are shown in Table 4.

COMPARATIVE EXAMPLE C4

Preparation of the foam of Comparative Example C1 was repeated, the Foam Expansion was measured, and the foam stability was tested by measuring Foam Height initially, at 24 hours, and at 48 hours. Results are shown in Table 4.

TABLE 4

| Example | Thickener Suspension | Foam Expansion | Initial Foam Height (mm) | 24 Hour Foam Height (mm) | 48 Hour Foam Height (mm) |
|---|---|---|---|---|---|
| C4 | None | 5.3 | 46.7 | <5.5 mm evaporated residue | <5.5 mm evaporated residue |
| 6 | Jaguar ™ 2243 MPA-1075 DPM PEG 300 | 3.2 | 26 | Not measured | 5.5 mm (foam layer over gel) |
| 7 | Actigum DPM | 2.75 | 24.7 | 19.5 | 14.7 |
| 8 | Jaguar ™ 2243 DPM | 3.5 | 28 | Not measured | 5.5 mm (foam layer over gel) |
| 9 | Jaguar ™ 2243 Kaolin DPM PEG 300 | 3.0 | 26.5 | 18 | 5.5 mm (foam layer over gel) |

The data in Table 4 show that the addition of the thickener suspensions of the present invention makes the foam stable for a much longer period of time than without the thickener suspensions, while at the same time allowing good foam expansion to occur.

COMPARATIVE EXAMPLE C5

A 3% tap water solution of FC-203CF (100 g) was mixed for 15 seconds in a Hobart (model N-50) mixer set on high speed. The resulting foam was poured into a 2000 mL glass beaker, the foam volume was measured for calculating Foam Expansion, and the foam was observed for 75% Drain Time. Results are shown in Table 5.

COMPARATIVE EXAMPLE C6

Three milliliters of PEG 300 was added to 97 g of a 3% tap water solution of FC-203CF in a Hobart mixer. Foam was generated and tested as in Comparative Example C5. Results are shown in Table 5.

EXAMPLES 10–19

Three milliliters of a 33% suspension of the thickener in PEG 300 was added to 97 g of a 3% tap water solution of FC-203CF in a Hobart mixer. This was immediately mixed on high for 15 seconds, and the resulting foam was poured into a 2000 mL glass beaker. The foam volume was measured for calculating Foam Expansion, and the foam was observed for 75% Drain Time. Results are shown in Table 5.

TABLE 5

| Example | Thickener | Foam Expansion | 75% Drain Time |
|---|---|---|---|
| C5 | None | 22 | 10.2 min. |
| C6 | None | 22 | 10.1 min. |
| 10 | Jaguar ™ 2243 | 16.5 | >12 hours |
| 11 | Xanthan/Locust Bean Gums (1:1) | 17 | >24 hours |
| 12 | Pusher 500 | 22 | 1.5 hours |
| 13 | Elvanol 72-60 | 21 | 11 min. |
| 14 | Soluble Starch | 22 | 10.2 min. |
| 15 | Gelatin GX45 L404 | 22 | 12.4 min. |
| 16 | Cyanamer A-370 | 21 | 20.8 min. |
| 17 | Klucel type J | 22 | 9.9 min. |
| 18 | Sodium Carboxymethylcellulose (DHT) | 21 | 8 hours |
| 19 | Jaguar Plus | 12.5 | 4.5 hours |

The data in Table 5 show that the addition of a variety of thickener suspensions increase foam stability, while allowing for excellent foam expansion.

EXAMPLE 20

Several single solution concentrates (SSC) containing both foam concentrate and thickener suspension were prepared by combining the ingredients, and blending for about 60 seconds in a blender until a smooth, creamy suspension was obtained. The amounts of each component of the SSCs, (in parts by weight solids for solid components, and in parts by weight solvent for solvents) is given in Table 6; the amount of water indicated in Table 6 is the maximum amount of water that may be present in the SSC due to the water's presence in one or more of the components.

TABLE 6

| Component | SSC-1 | SSC-2 | SSC-3 | SSC-4 | SSC-5 |
|---|---|---|---|---|---|
| Amine Oxide Foamer A | 3.6 | | | | |
| Amine Oxide Foamer B | | 3.6 | 3.6 | 3.6 | 1.8 |

TABLE 6-continued

| Component | SSC-1 | SSC-2 | SSC-3 | SSC-4 | SSC-5 |
|---|---|---|---|---|---|
| Miranol C2M-SF A | 2 | 2 | | | |
| Miranol C2M-SF B | | | 1 | | |
| Mirataine CBS | | | | 0.75 | 2 |
| SOS | | | | 1.4 | |
| SLS | 3 | 3 | 3 | | 3 |
| Witcolate 7093 | | | 1 | 2.25 | |
| SDS | | | | 0.6 | |
| Tolytriazole | 0.05 | 0.05 | 0.05 | 0.05 | 0.05 |
| DPnP1 | 4 | 4 | 4 | 4 | 4 |
| DPM | 51.08 | 47.3 | 55.04 | 39.2 | 49.55 |
| Kelzan ™ | 0.925 | 0.925 | 0.925 | 0.925 | 0.925 |
| Starch H277 | 0.75 | 0.75 | 0.75 | 0.75 | 0.75 |
| Jaguar ™ 2243 | 30 | 30 | 30 | 30 | 30 |
| Rheolate 2001 | 0.75 | 0.75 | 0.75 | 0.75 | 0.75 |
| Water | 1.67 | 2.61 | 3.24 | 5.13 | 2.42 |

EXAMPLES 21–25

Each single solution concentrate made in Example 20 was combined in the amount of 3 mL with 97 mL of tap water in a Waring (model 31BL91 7010) blender, and mixed at the high speed setting for 10 seconds. Foam Expansion, and Foam Height were measured. In addition, the consistency of the foam was evaluated according to the following criteria:

firm foam—a foam which will form and hold a peak (similar to whipped cream)

thick foam—a foam which will form but not hold a peak normal foam—a foam which will not quite form a peak (This is the consistency of the foam generated when 3% ATC-603 alone in tap water is mixed in the Waring blender at the high speed setting for 10 seconds.)

Results are shown in Table 7.

EXAMPLE 26

A combination of 97 g of 3% ATC-603 in tap water and 3 mL of 33% Jaguar™ 2243 in DPM was prepared and immediately mixed in the Waring blender at the high speed setting for 10 seconds. The resulting foam was tested as in Examples 21–25, and the results are reported in Table 7 as Foam Expansion (FX), Foam Height (FH) Over Time, and Foam Consistency of Aerated Single Solution Concentrates (SSC).

TABLE 7

| Example | SSC | FX (mm) | Initial FH | 24 Hour FH (mm) | 48 Hour FH (mm) | 72 Hour FH |
|---|---|---|---|---|---|---|
| 21 | SSC-1 | 3.8 | 31/firm | 22/firm | Thin layer foam over gel | Thin layer foam over gel |
| 22 | SSC-2 | 4.2 | 37/firm | 29/firm | 13 foam over gel | Thin layer foam over gel |
| 23 | SSC-3 | 4.0 | 32/firm | 25/firm | Thin layer foam over gel | Thin layer foam over gel |
| 24 | SSC-4 | 3.8 | 29/thick | 23/firm | Thin layer foam over gel | Thin layer foam over gel |
| 25 | SSC-5 | 3.9 | 30/thick | 23/firm | 11 foam over gel | Thin layer foam over gel |
| 26 | No SSC | 3.2 | 27/firm | 21/firm | Thin layer foam over gel | Thin layer foam over gel |

The data in Table 7 indicates that single solution concentrates provide good foam expansion and excellent foam stability (comparable to or better than combining separate mixtures of foam concentrate and thickener suspension shown in Example 26); even though low levels (<~5%) of water are present in the concentrates.

EXAMPLE 27

A single solution concentrate was prepared by combining and blending the following components in a Waring laboratory blender (model 31BL91 7010) for 60 seconds on the high speed setting. A smooth, creamy suspension was produced.

| Component | Parts by weight |
|---|---|
| Dupanol ME powder | 8.0 |
| Kelzan ™ | 1.0 |
| Starpol 530 | 1.0 |
| Jaguar ™ 2243 | 33.0 |
| MPA 1075 | 1.5 (solids) |
| Bentone SD2 | 0.5 |
| DPM | 55.0 |

An aerated foam was made from the above concentrate and water, using the Foam Generation Procedure, and evaluated with the Fire Extinguishing Test. Results are shown in Table 8.

TABLE 8

| Flammable Liquid Fuel | Fire Extinguishing Time (sec) | Amount of Foam Used (g) | Foam Application Rate (g/sec/m$^2$) |
|---|---|---|---|
| IPA | 47 | 165 | 9.98 |
| Acetone | 36 | 131 | 10.3 |
| Gasoline | 63 | 175 | 7.99 |
| MTBE | 45 | 170 | >10.4 |

The data in Table 8 shows effective fire extinguishing capability of an aerated foam made with a single solution concentrate without a fluorocarbon component.

EXAMPLE 28

A thickener suspension was prepared as in Example 1 with the following components:

| Component | Parts by weight |
|---|---|
| MPA 1075 | 0.7 (solids) |
| Bentone SD2 | 0.4 |
| Jaguar ™ 2243 | 33 |
| DPM | 65.04 |

An aerated foam was made with the above thickener suspension in a 3% tap water premix of FC-203CF, according to the Foam Generation Procedure, and evaluated with the Fire Extinguishing Test. Results are shown in Table 9.

TABLE 9

| Flammable Liquid Fuel | Fire Extinguishing Time (sec) | Amount of Foam Used (g) | Foam Application Rate (g/sec/m2) |
|---|---|---|---|
| IPA | 30 | 112 | 8.2 |
| Acetone | 49 | 163 | 9.47 |
| Gasoline | 23 | 99 | >10.4 |
| MTBE | 25 | 75 | 9.53 |

The data in Table 9 shows the effective fire extinguishing capability of an aerated foam made with the addition of a thickener suspension.

What is claimed is:

1. An aqueous stabilized foam composition comprising water, from about 0.05 to 1 weight percent surfactant based on the total weight of the composition; and from about 0.5 weight percent of a non-fully thickened thickener based on the weight of the composition, wherein said foam composition has a 75% drain time of up to about 24 hours.

2. The composition of claim 1, further comprising organic solvent.

3. The composition of claim 1, wherein the composition contains essentially no crosslinker, polyvalent ionic complexing agent, or protein hydrolysate, and wherein the foam composition has a 75% drain time of at least 3 hours.

4. A composition comprising about 1 to 66 weight percent non-fully thickened thickener, about 1 to 25 weight percent surfactant, and about 30 to 95 weight percent organic solvent, based on the total weight of the composition.

5. The composition of claim 1, wherein the foam composition has a 75% drain time of up to about ninety minutes.

6. The composition of claim 1, wherein the foam composition has a 75% drain time of up to about 12 hours.

7. The composition of claim 1, wherein the foam composition is in stabilized form up to about 24 hours.

8. The composition of claim 1, wherein the foam composition is in stabilized form up to about 48 hours.

* * * * *

UNITED STATES PATENT AND TRADEMARK OFFICE

CERTIFICATE OF CORRECTION

PATENT NO. : 6,528,544 B2
DATED : March 4, 2003
INVENTOR(S) : Stern, Richard M.

It is certified that error appears in the above-identified patent and that said Letters Patent is hereby corrected as shown below:

Column 8,
Line 14, delete "Coo" and insert in place thereof -- COO --
Line 15, delete "$(C_3F_5O)_3$" and insert in place thereof -- $(C_3F_6O)_3$ --
Line 31, delete "(II)" and insert in place thereof -- (H) --
Line 32, delete "$C_5$" and insert in place thereof -- $C_6$ --

Column 10,
Line 14, delete "non=hydrated" and insert in place thereof -- non-hydrated --
Line 41, delete "thcikener" and insert in place thereof -- thickener --

Column 18,
Line 38, under "Table 2", "Example C2, last column, delete "125" and insert in place thereof -- 12.5 --

Signed and Sealed this

Thirteenth Day of April, 2004

JON W. DUDAS
*Acting Director of the United States Patent and Trademark Office*